US006000837A

United States Patent [19]

Randsborg et al.

[11] Patent Number: 6,000,837

[45] Date of Patent: Dec. 14, 1999

[54] ARRANGEMENT IN A MIXER, ESPECIALLY FOR MIXING PRINTING COLOR

[76] Inventors: Torbjørn Randsborg, Lindehaugsvingen 12C, Høvik, Norway, N-1322; Morten Bjelland, Anthon Walles vei 6, Sandvika, Norway, N-1300

[21] Appl. No.: 08/894,891

[22] PCT Filed: Feb. 27, 1996

[86] PCT No.: PCT/NO96/00045

§ 371 Date: Aug. 29, 1997

§ 102(e) Date: Aug. 29, 1997

[87] PCT Pub. No.: WO96/26889

PCT Pub. Date: Sep. 6, 1996

[30] Foreign Application Priority Data

Jan. 3, 1995 [NO] Norway ..... 950797
Mar. 11, 1995 [NO] Norway ..... 954406

[51] Int. Cl.[6] ..... B01F 15/04

[52] U.S. Cl. ..... 366/141; 366/182.4

[58] Field of Search ..... 366/182.4, 182.2, 366/182.1, 177.1, 179.1, 181.8, 189, 150.1, 141; 222/145, 145.5, 255, 256, 310, 77; 141/83

[56] References Cited

U.S. PATENT DOCUMENTS 4,302,113 11/1981 Rumfola ..... 366/150.1
4,688,944 8/1987 Mumenthaler .
4,844,297 7/1989 Smith .
4,871,262 10/1989 Krauss et al. ..... 366/182.2
4,924,900 5/1990 Taube, Sr. et al. .
4,944,599 7/1990 Soechtig .
4,946,284 8/1990 Teranishi et al. .
5,020,917 6/1991 Homan ..... 366/181.8
5,163,010 11/1992 Klein et al. ..... 366/141
5,350,233 9/1994 Sonntag et al. .
5,375,634 12/1994 Egger .

FOREIGN PATENT DOCUMENTS 0176140 4/1986 European Pat. Off. .
3201221 7/1983 Germany .
3419485 11/1985 Germany .
3729318 8/1994 Germany .
4322442 1/1995 Germany .
2103951 3/1983 United Kingdom .

*Primary Examiner*—Tony G. Soohoo
*Attorney, Agent, or Firm*—Reed Smith Shaw & McClay LLP

[57] ABSTRACT

The present invention relates to an arrangement in a mixer (1), especially for mixing printing color, and for the objective of achieving an automatic process rendering a very accurate mixing result, it is in accordance with the present invention suggested that the arrangement comprises a plurality of color containers (2*a*–2*n*) each containing a base color, and being connected to outlet conduits (3*a*–3*n*) through which the base color can be delivered to a valve carrying color distributor (10) which can be brought in communication with the individual color containers (2*a*–2*n*) via the outlet conduits (3*a*–3*n*), and a controller (4) which according to a preset program influences the color distributor (10) to let through a desired quantity of base color from preselected color containers (2*a*–2*n*) to a common mixing vessel (6), preferably on a weight basis.

15 Claims, 6 Drawing Sheets

ARRANGEMENT IN A MIXER, ESPECIALLY FOR MIXING PRINTING COLOR

FIELD OF THE INVENTION

The present invention relates to an arrangement in a mixer, especially for mixing printing color.

BACKGROUND OF THE INVENTION

The present invention has been developed especially in connection with mixing of colors for offset-printing, such colors having a relatively high viscosity, but the invention is not limited to offset-color and can be used for mixing other colors, provided the invention can be used in connection with viscosity values associated with such further colors.

Generally, printing color is manufactured in the color factory in limited series from so-called base colors. On the basis of these base colors there exists a wide spectre of defined colors, i.e. with a prescription consisting of an accurate mixing ratio.

In order to achieve correct color, or color mixing, the prescription must be adhered to with great accuracy, since small deviations will give wrong color result.

PRIOR ART

It is today known that color mixing within the graphic industry or mixing of offset-colors takes place by a manual process, wherein the only auxiliary means during the color mixing is a scale. This is a time consuming and very difficult task if the result is to be a completely accurately prescribed end color.

Consequently, the prior art manual method is hampered with the following disadvantages:

- inaccurate end colors,
- long mixing time (which involves costly machine time on the printing machine),
- difficulties in achieving the same result if several mixings are made,
- more color than needed is to be mixed in order to secure enough quantity of color, which entails large wastage.

Besides, from GB-A-2 103 951 there is known a multi component valve serving to mix predetermined gas components received from separate pressure supply tanks, which valves not straight away can be used for mixing printing color.

From U.S. Pat. No. 4,688,944 there is known a mixing head for reactive mixture of two or more plastic components in a mixing chamber, there being used a respective dosage valve during a supply step and a respective recirculation valve in a later recirculation step.

From U.S. Pat. No. 4,944,599 there is know a system with closed feedback loop control for a high pressure mixing system. The system comprises a displaceable nozzle needle regulating pressure and volume as well as other parameters in the mixed product.

From U.S. Pat. No. 4,946,284 there is known a mixing head for mixing liquid state material, comprising supply channels to a mixing chamber and return channels. Besides, there is used a first valve for opening the inflow to the mixing chamber and a second valve for opening and closing the return channels.

None of said publication gives any information about valves comprising two or more color throughputting openings for crude and fine dosage of color, respectively.

OBJECTS OF THE INVENTION

The object underlying the present invention is to avoid the previously discussed disadvantages with which the prior art technique is hampered, for thereby providing an arrangement in a mixer whereby is achieved:

- accurate mixing result each time mixing takes place,
- only mixing of the required quantity of color,
- accurate copying of the previously mixed color without deviation,
- automatic process in a color mixer, such that the printer can be released for preparing the printing machine,
- simplified buying routines comprising only base colors,
- improved color logistic, there only being need for having base colors and no need for making special colors,
- avoiding waiting time when ordering special colors from supplier,
- saving mixing addition from color supplier,
- all colors of the spectrum is automatically available, stored in a database.

BRIEF DISCUSSION OF THE INVENTION

These objects are achieved in an arrangement in a mixer of the type as stated in the preamble, which according to the invention is characterized in that the arrangement comprises a plurality of color containers each containing a base color, as well as output conduits through which base color can be delivered to a valve carrying distribution means which can be brought in communication with the individual color containers via said outlet conduits, as well as control means which according to a preset program influences the distribution means to let through a desired quantity of base color from preselected color containers to a common mixing vessel, preferably on a weight basis.

Further features and advantages in connection with the present invention will appear from the following description taking in connection with the appended drawings, as well as from the appended patent claims.

DETAILED DESCRIPTION OF EMBODIMENTS

Figure 1:
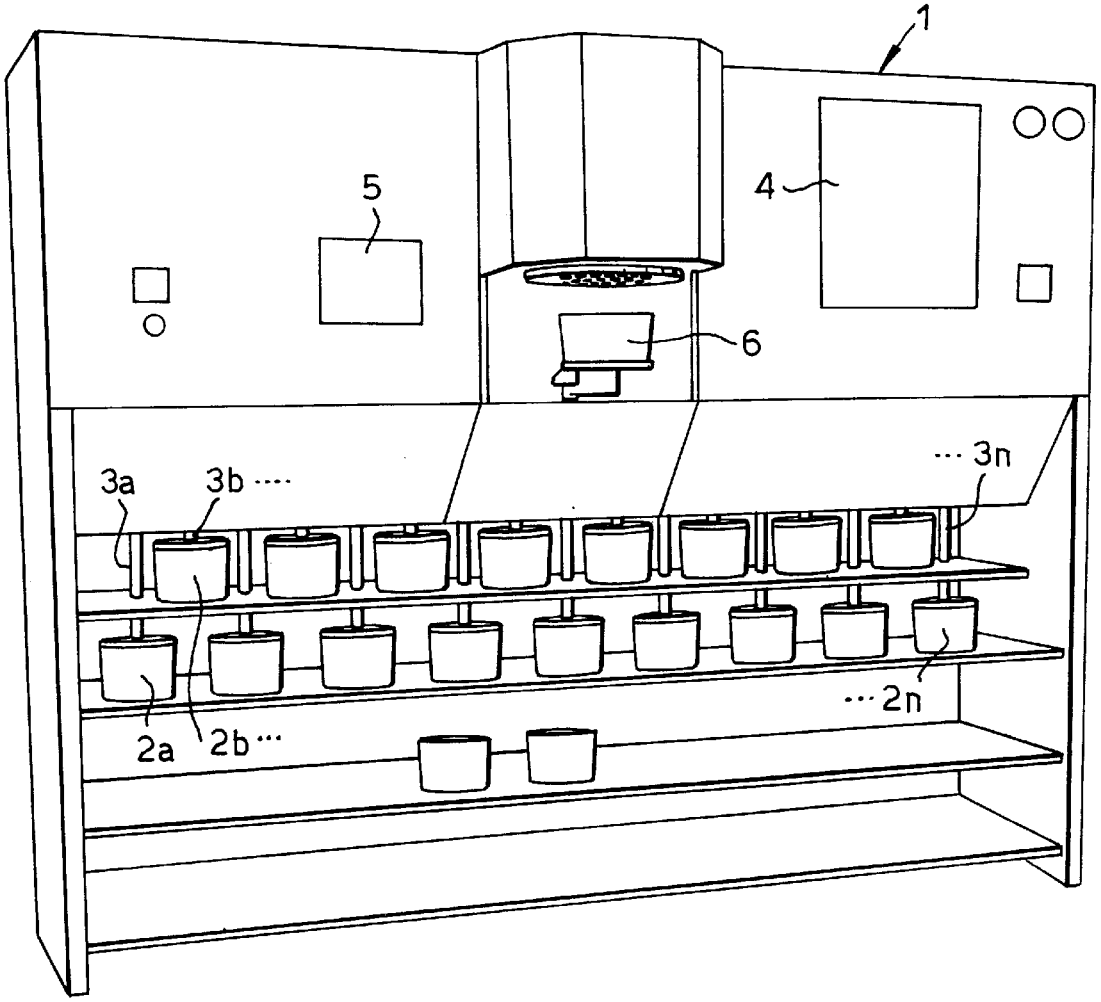
FIG. 1 is a schematic perspective view illustrating an example of how an arrangement in a mixer according to the invention can be implemented.

In FIG. 1 which schematically and perspectively is a view illustrating an example of how an arrangement in a mixer according to the invention can be implemented, the arrangement proper is stated by reference numeral 1. The present arrangement which is specifically developed in connection with the mixing of printing colors for graphics or offset-color, but which can also be used for mixing other appropriate colors, comprises a plurality of color containers 2*a*, 2*b* . . . 2*n*, each of which containing a so-called base color. The number of such color containers 2*a*, 2*b* . . . 2*n* can, of course, be varied within wide limits and an appropriate number in the embodiment according to FIG. 1, has been chosen as 17. Each of these 17 color containers 2*a*, 2*b* . . . 2*n* is connected to an individual output conduit 3*a*, 3*b* . . . 3*n* through which the base color can be passed to a valve carrying distribution means, which means will be further described in the following, but which can be brought in communication with the individual color containers 2*a*, 2*b* . . . 2*n* via said outlet conduits 3*a*, 3*b* . . . 3*n*, respectively. This communication is taken care of by control means 4 which according to a preset program, for example by means of a control panel 5, influences the mentioned distribution means to let through the desired quantity of base color from preselected color containers to a common mixing vessel 6, preferably on a scale basis.

By means of said control or operating panel 5 the operator can thus firstly chose the quantity of color which is desired, for example a batch quantity of 50–200 g to 2500 g. Thereafter, the operator punches in the percentage part corresponding to the color prescription, which can comprise for example five colors or more, the sum of said percentage parts summing up to 100%. Thereafter, the operator pushes on start and the arrangement according to the invention carries out the necessary operations so that the predetermined quantity of colors is taken out with the correct percentage part from the selected base color containers for the collection thereof in a common mixing vessel 6 in accordance with the selected colors prescription.

It is to be understood that within said batch sizes from approx. 50–200 g to 2500 g, the mixture may be fine adjusted with quantities of colors of quantity range 0,2 g, or less, which involves that most of the practical color prescriptions can be mixed very accurately both at the initial mixture and by repeating mixtures.

Figure 2:
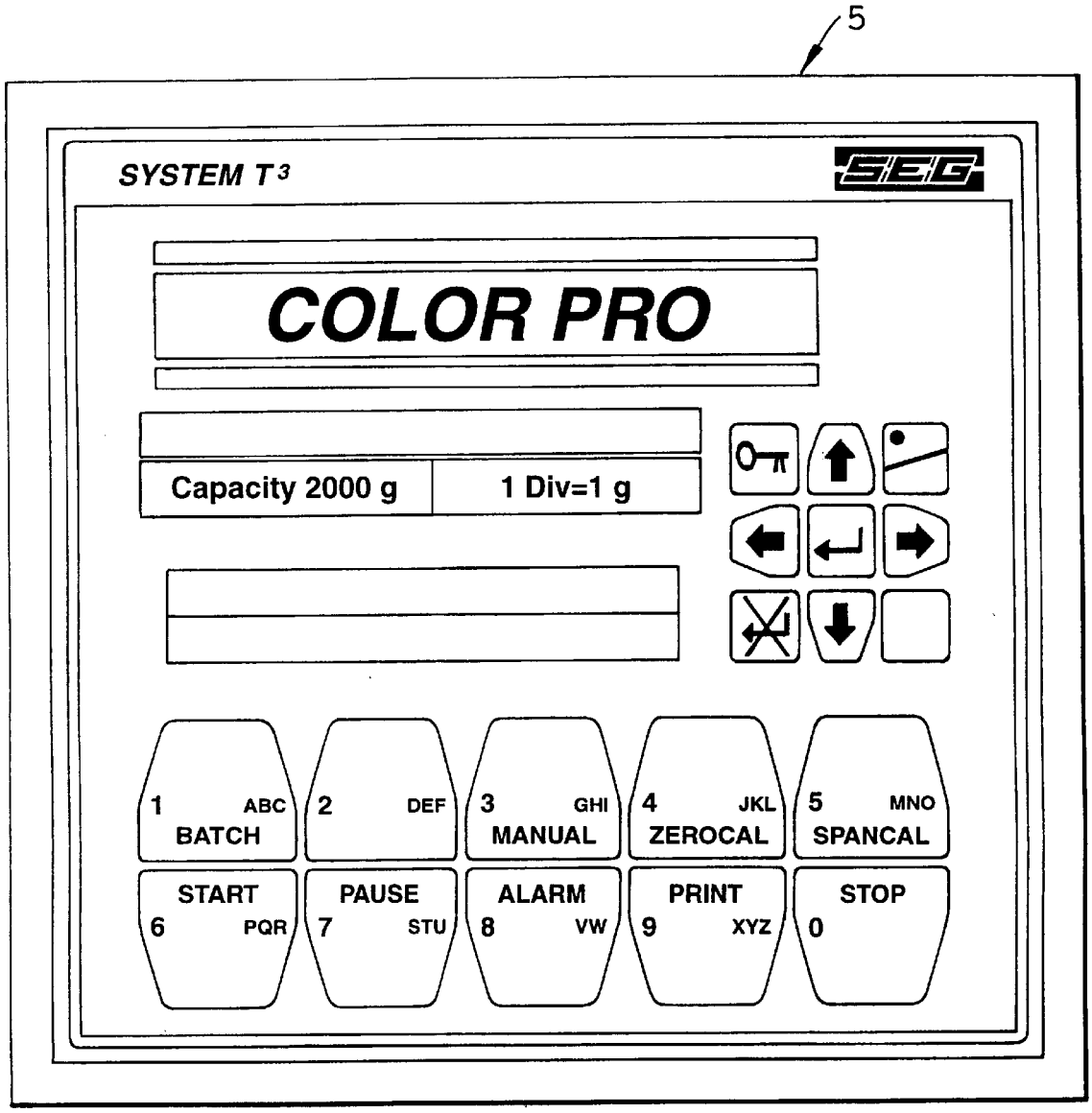
FIG. 2 illustrates, on a larger scale, an example of an operator panel which is used in the arrangement illustrated in FIG. 1.

In FIG. 2 there is, on a larger scale, illustrated an example of how an operator panel 5 can be designed, especially for use in the arrangement which is schematically illustrated in FIG. 1. It is to be understood that together with the finished mixture in the mixing vessel 6 the control means 4 can print out the prescription as punched, which appropriately can be stored in the system, or be printed out as a delivery note together with the finished mixture.

Figures 3, 7:
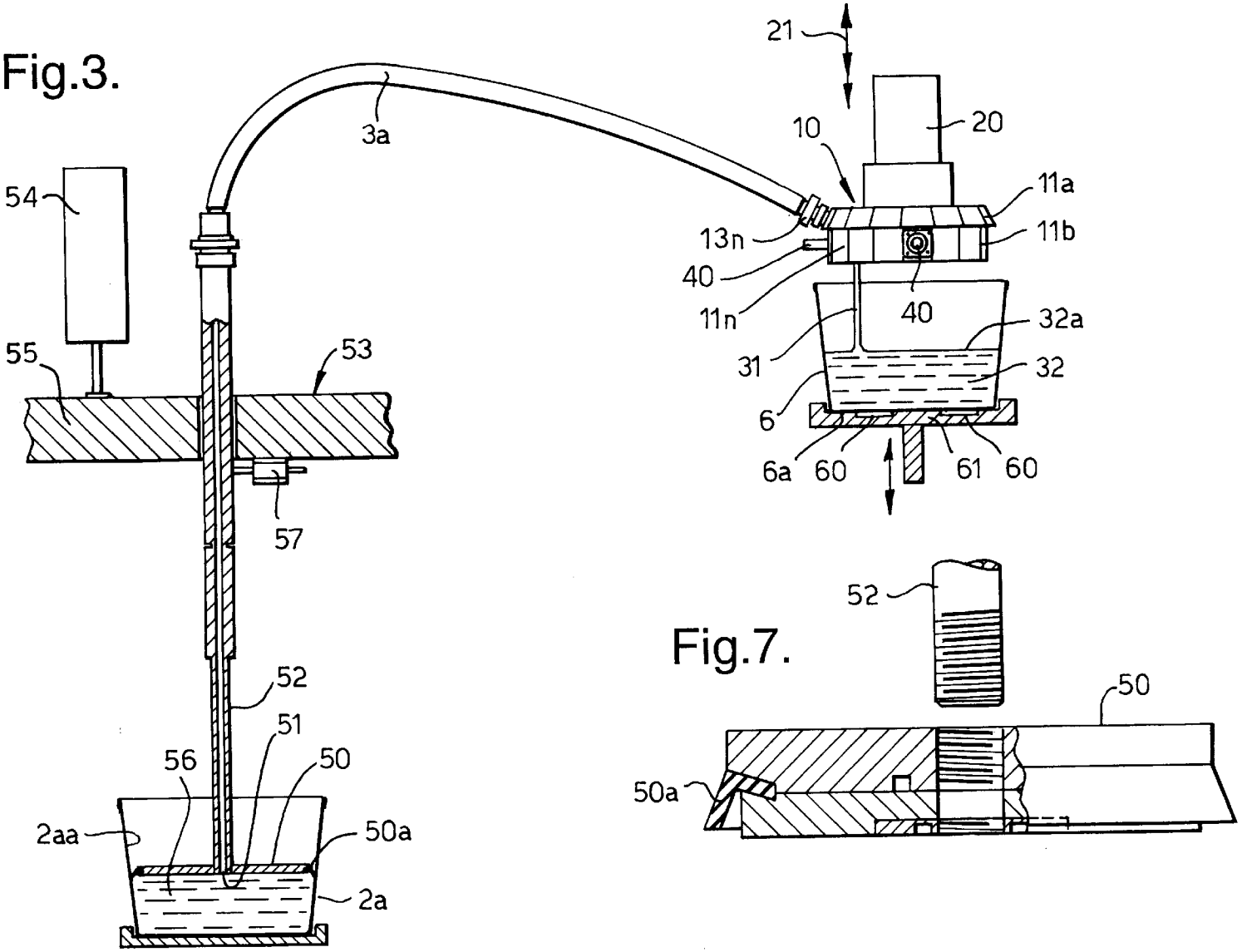
FIG. 3 is a schematic principle sketch illustrating a non-limiting embodiment of an arrangement according to the present invention.
FIG. 7 illustrates, on a larger scale, a view partly in section of a combined lid and piston illustrated in FIG. 3.

In FIG. 3 there is depicted a schematic principle sketch giving an overview on how a non-limited embodiment of an arrangement according to the invention can be realized. In FIG. 3 one can once more find one of the color containers 2*a* which via its outlet conduit 3*a* is in stand-by connection with a previously discussed valve carrying distribution means 10 comprising a plurality of valve sections 11*a*–11*n*, preferably arranged in a ring, above the common previously discussed mixing vessel 6 illustrated in FIG. 3.

Figure 4:
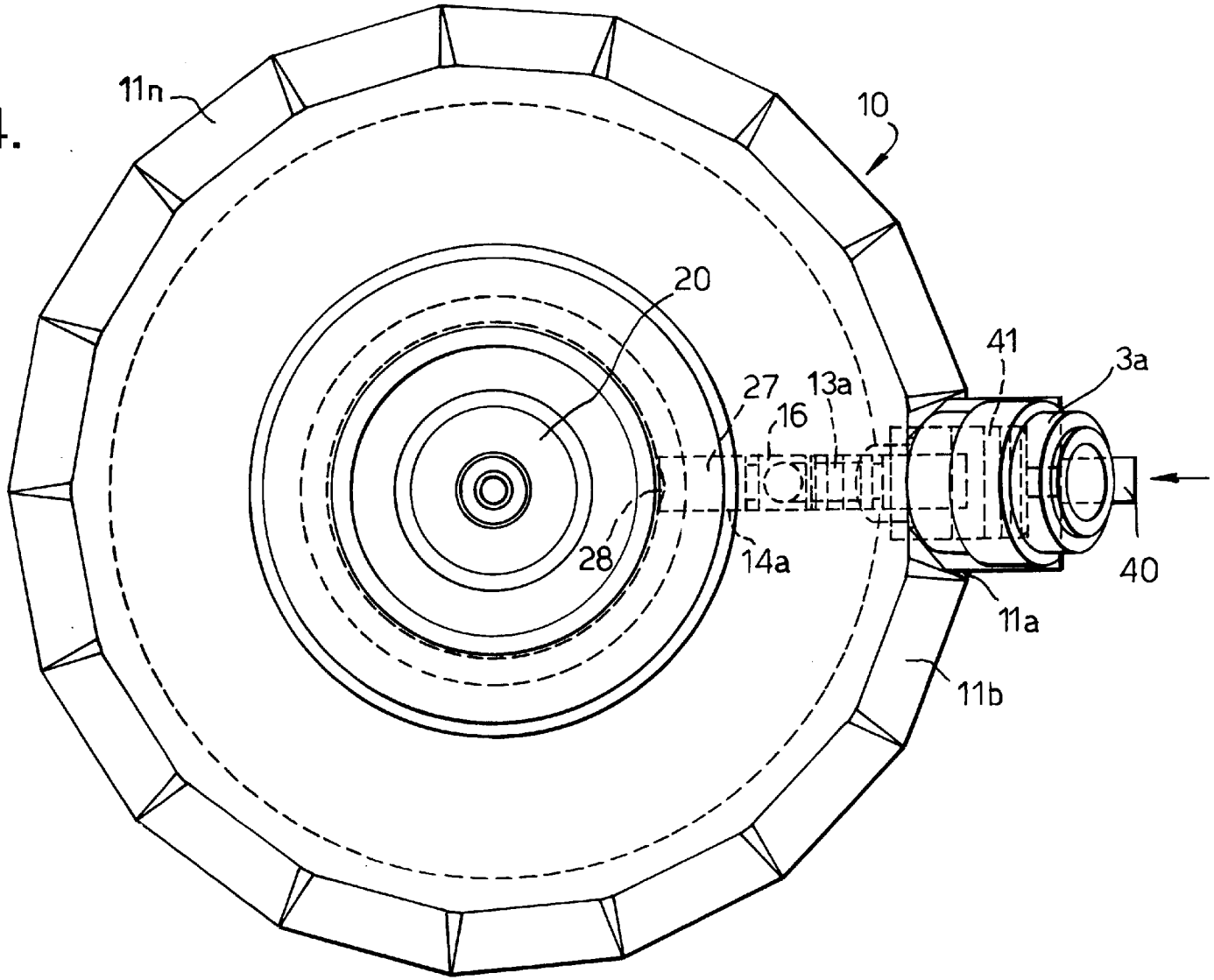
FIG. 4 is a view as seen from above of a main member included in a special embodiment of a distribution means in an arrangement according to the present invention.
Figure 5:
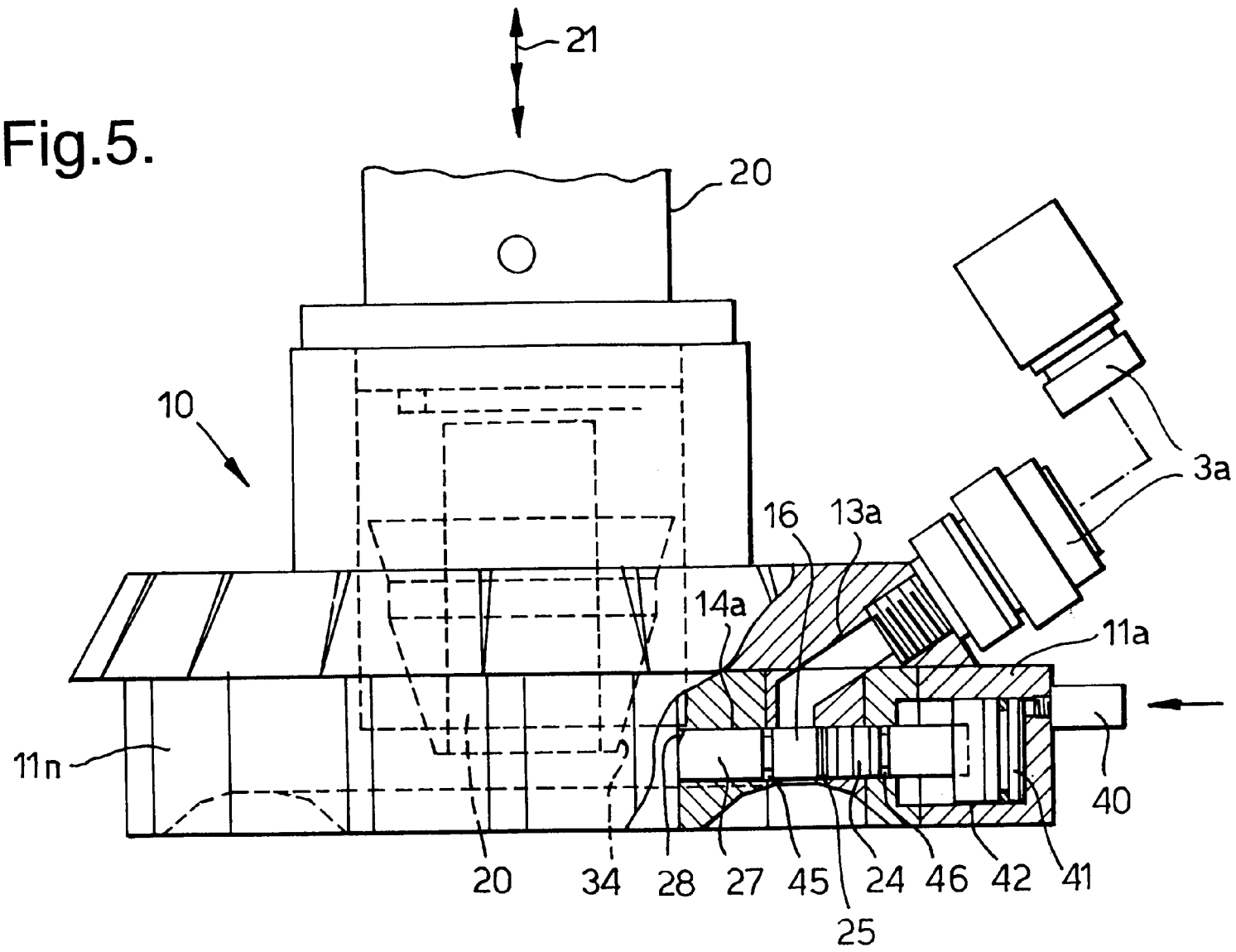
FIG. 5 is a side view of the main member illustrated in FIG. 4.

In FIGS. 4 and 5 illustrating a view as seen from above and a side view, respectively, of an assembled main member which is included in said distribution means 10, it appears herefrom that the distribution means 10 itself comprises for example 17 valve sections 11*a*–11*n* arranged in a ring, each valve section 11*a*–11*n* on the one side via appropriate inlet openings 13*a*–13*n* being connected to each individual of said mentioned outlet conduits 3*a*–3*n* extending from the respective color container 2*a*–2*n*, and on the other side being adapted to appropriately recessed valve housings 14*a*–14*n* to hold regulating valve.

Figure 6A:
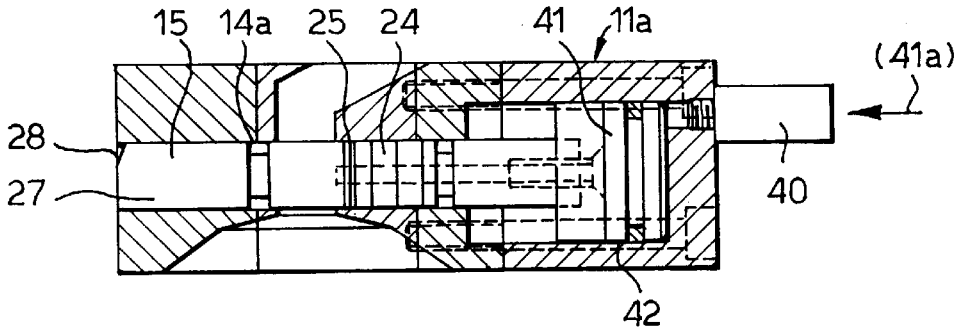
FIGS. 6A, 6B and 6C illustrate, on a larger scale, one of the valve sections included in the main member illustrated in FIGS. 4 and 5.
Figure 6B:
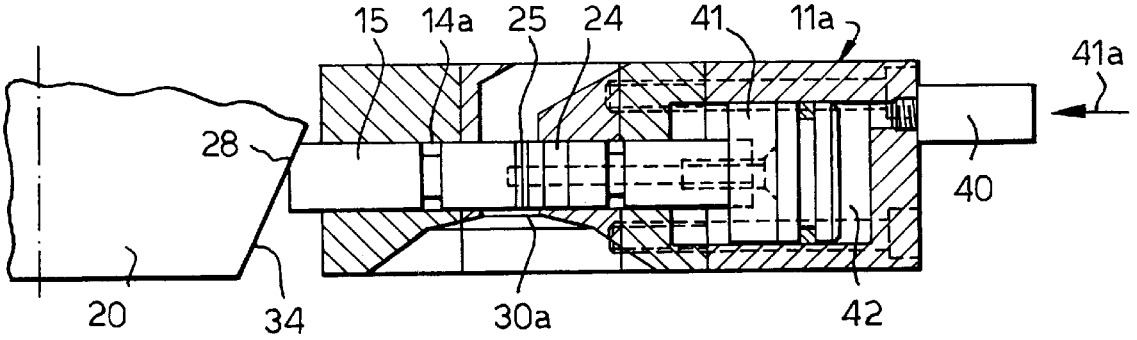
Figure 6C:
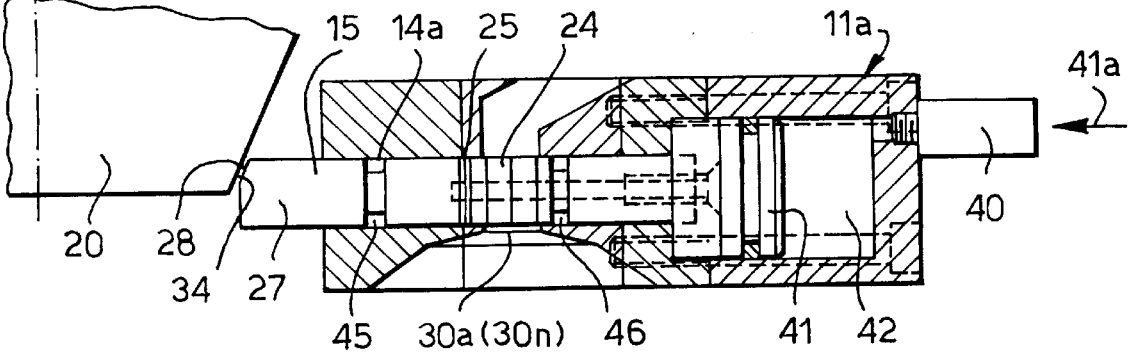

In FIGS. 6A–6C there is, at a somewhat larger scale, illustrated one of the valve sections 11*a* with its valve housing 14*a*.

A valve which can be held by respective valve housings 14*a*–14*n* is illustrated in FIGS. 4, 5 and 6, here generally designated by reference numeral 15, said FIGS. 6A–6C illustrating the valve 15 in various operating positions, as this will be further discussed in the following.

It is once more referred to FIG. 3, and in connection with the embodiment illustrated there, it is to be understood that the distribution means 10 is substantially stationary provided, the latter encircling a valve control means which generally is designated by reference numeral 20, and which can be brought to selected position in relation to the individual valve section 11*a*–11*n* in order to contribute to a correct stroke length by opening/closing the respective valve 15 arranged therein, and then in accordance with the preprogramd color prescription.

The valve control means 20 can appropriately be connected to a drive means 21, for example a pneumatic drive means, for thereby displacing the valve control means 20 to preselected positions, which preselected positions are controlled by the previously discussed control means 4, see FIG. 1.

In FIG. 3 and FIG. 5 the drive means 21 is symbolized by means of a triple arrow, which will indicate that the valve control means in an appropriate embodiment can be given appropriate lowering motions, as well as one or more appropriate raising movements, all of which being adapted to the remaining shape of the valve control means 20 itself, and the manner in which it communicates with the respective valves 15 in the respective valve housings 14*a*–14*n*.

It is to be understood that said control means 4 cooperate with the valves 15 arranged in the distribution means 10 in such a way that when a color prescription has been punched for each valve 15 in question or valve housing 14*a*–14*n* in question, there can be effected both crude dosage and/or fine dosage for achieving an accurate color mixture. If there is a need for only one crude dosage and one fine dosage, then the individual valves 15 can be designed as this is illustrated in detail in FIGS. 4, 5 and 6A–6C, namely with at least two color throughput openings, respectively a larger throughput opening 24 serving for crude dosage of the color in question, as well as a smaller opening 25 serving for fine dosage of the color in question. Examples of diameter of the openings can be 8 mm and 1,5 mm, respectively, but these dimensions can of course vary within wide limits.

In FIGS. 4, 5 and 6A–6C it is illustrated that each valve 15 is provided in a respective valve housing, 14*a*–14*n*, each valve 15 comprising a substantially cylinder-shaped main member 16 having a first end portion 27 which is provided with a substantially inclined control surface 28 which is adapted to cooperate with an oppositely inclined surface 34 on the valve control means 20 in dependence of the position which the associated raising/lowering mechanism 21 has communicated to the valve control means 20. Further, from FIGS. 3, 4, 5 and 6A–6C it appears that the individual valve 15 is in a valve housing 14*a*–14*n* which is connected to a pipe piece 40 for the supply of pressure air 41, which pressure air will be supplied via appropriate not illustrated individual hoses, which can have a common pressure air source or compressed air generator.

An example of a dosing course can be read from FIGS. 6A–6C, and in connection with FIG. 5, FIG. 6A illustrating a position in which both throughput openings or dosing openings 24 and 25 are in a retracted position, i.e. closed position, see also FIG. 5.

In case a dosage through the largest opening 24 is desired, then compressed air 41*a* will be communicated via the pipe piece 40, as this is illustrated in FIG. 6C, and the compressed air will then guide a piston 41 in a piston chamber 42 from the right position illustrated in FIG. 6A to the outermost left position illustrated in FIG. 6C, in which the inclined surface 28 of the piston body 16 itself will rest against the inclined surface 34 on the previously discussed valve control means 20. This displacement of the valve 15 will then entail that the thoroughgoing opening 24 for the crude dosage is flush with a respective outlet opening 30*a*–30*n* for the respective valve section 11*a*–11*n*, here section 11*a*, see especially FIG. 6C. In accordance with the preprogrammed crude dosage quantity, this flush position of the thoroughgoing opening 24 and the outlet opening 30*a* remain until the crude dosage quantity has been let through and ended up in the previously discussed mixing vessel 6, see FIG. 3.

If thereafter a fine dosage is wanted, i.e. a dosage through the lesser throughput opening 25, the program will order the drive means 21 of the valve control means 20, such that the valve control means 20 is lowered to an intermediate position which entails that the inclined surface 34 of the valve control means 20 will force the valve 15 to return into the valve housing 14*a* with a distance corresponding to the flushing of the lesser throughput opening 25 with the previously discussed outlet opening 30*a* which communicates with the corresponding supply hose 3*a*, the larger throughput opening 24 now being pulled into the valve housing 14*a* to a passive position, see especially FIG. 6B.

Said displacement of the inclined surface 34 of the valve control means 20 will thus bring the valve 15 to a position wherein the throughput opening 25 for fine dosage will match the corresponding outlet opening 30*a*–30*n* on the bottom side of the distribution means 10, such that an appropriately dosed color quantity 31, see FIG. 3, can mix with the previously filled color 32 in said collecting vessel 6.

It is to be understood that during the up till now discussed two operational steps the compressed air 41*a* will continuously be supplied through the supply piece 40, such that the lowering movement of the inclined surface 34 of the valve control means 20 will press the valve 15 into the valve housing 14*a* towards the air pressure acting on the piston 41 in the respective valve housing, see FIGS. 6C and 6B.

After the fine dosage has also been terminated, the raising/lowering mechanism 21 will once more be activated, and then in such a manner that the valve control means 20 will be brought to its bottom lower position, which entails that the upper part of the inclined surface 34 will force the piston 15 all the way into the valve housing 14*a*, for complete closing of the valve, i.e. back to the starting point illustrated in FIG. 6A. At this stage the compressed air can be released and the used valve 15 will then remain in the valve housing 14*a* also after the retrieval of the valve control means 20 to its initial position, as this is illustrated in FIG. 5, namely to its position illustrated with solid lines, wherein the lower portion of the inclined surface 34 is spaced from the corresponding inclined surface 28 of the respective valve 15, but still so far down that the inclined surface 34 can constitute a counter means if, in connection with the next valve, start-up will be with a crude dosage.

If, in connection with a valve, only a fine dosage is to be effected, i.e. only the lesser opening 25 shall be effective, i.e. is to be brought flush with the outlet opening 30*a*, there will initially be given a signal to the valve control means 20 for this to be lowered to its intermediate position, see especially FIG. 6B, before pressure air 41*a* is supplied via the supply piece 40 for influencing the piston 41 in the piston chamber 42, for thereby bringing the valve 15 to said fine dosage position.

Since the valve control means 20 has a lower part having conical portions 34, it is sufficient that the valve control means 20 is given a raising and lowering movement when the respective valves are to execute their dosage operations, i.e. turning of the valve control means 20 is avoided since the respective operation of the valves 15 is taken care of by separate compressed air supplies, see reference 40 in FIGS. 3, 4, 5 and 6A–6C.

It is further to be understood that in the discussed embodiment in a valve control means 20 in the form of a raisable/lowerable large piston having inclined surfaces 34, it is possible in a simple manner to perform maintenance and tests of the mixing arrangement itself. For example, a test program can be inserted for cleaning or control of the displaceability of the pistons or valves, namely the valves 15, in that the valve control means 20 is lowered to its intermediate position, i.e. the position for fine dosage, whereafter compressed air is supplied to all piston chambers 42 for advancing all valves 15 a little distance until the respective inclined surfaces 28 of the valves 15 will abut against the inclined surface 34 of the valve control means 20, see for example FIG. 6B, whereafter the valve control means 20 in the course of a fraction of a second is lowered to its bottom position for retrieving all pistons, i.e. so quickly that color does not leak out through the dosage openings. Thereafter the compressed air is shut off and the valve control means 20 is raised to its initial position, see FIG. 5.

As mentioned, the distribution means 10 is appropriately arranged in a ring around the valve control means 20, and a further appropriate manner in which to design the distribution means 10 is as a tiltable arrangement, which will render inspection and maintenance easier.

In FIGS. 5 and 6A–6C there is also illustrated O-rings 45 and 46 arranged in opposite circumferential recesses for appropriate sealing of the respective valves 15, respectively their valve bodies 16 in respective valve housings 14*a*–14*n* for the intermediate portion housing the graduated valve openings 24 and 25.

A variant of an embodiment of distribution means can be reside in letting the valve control means being provided without bottom inclined surfaces, but only as a substantially cylindrical piston which can take only two positions, namely an upper position allowing full stroke of the respective valve for bringing the largest throughput opening to flush with the outlet opening above the mixing vessel, as well as a lower position allowing for the valve only to have a reduced stroke bringing the lesser throughput opening to flush with the respective outlet opening in the valve section in question.

Such a variant will require a two-way pneumatic or hydraulic control of the valve which is arranged in the individual valve section or valve chamber, namely either a double supply of compressed air hoses to the piston chambers for the control of compressed air "behind" and "ahead of" said piston, or a special two-way valve with associated control means for controlling the same compressed air on the one or second side of the piston.

A mixing course can then take place by the following steps:

a) the valve control means is in an upper position, b) compressed air is supplied "behind" the piston in the piston chamber in the valve section in question, c) the piston is driven to its end stroke and brings the crude dosage opening of the valve to be flush with the outlet hose and outlet opening respectively for crude outlet dosage of preselected quantity of color to a collecting vessel, d) the piston in the piston chamber receives compressed air "ahead of" the piston, whereas compressed air "behind" the piston is reduced or removed, and the piston is returned to its rear initial position, whereafter pressure air "ahead of" the piston is removed, e) the control means is lowered to its bottom position, also designated as abutting position, f) compressed air is supplied once more "behind" the piston which is driven out to an intermediate stroke of the valve, wherein the fine dosage opening is brought flush with the respective outlet house and outlet opening for fine output dosage of preselected quantity of color to the collecting vessel, g) compressed air is supplied "ahead of" the piston, and compressed air "behind" the piston is reduced, such that the piston with its valve is brought to its rear initial position in the corresponding piston chamber, h) the valve control means is raised to its non-abutting position.

In FIG. 3 it is illustrated that each of said color containers, here the color container 2*a*, comprises a displaceable piston 50 operating as a lid and at its center portion being provided with an outlet opening 51 which in turn via a hollow piston rod 52 is connected to the previously discussed outlet conduit 3*a*.

The piston rod 52 is connected to a drive means which generally is designated by reference numeral 53, and which cooperates with said control means 4, for thereby being able to be influenced by means of a power cylinder 54 and via a lowering jib 55 to move the piston 50 down into or into the selected color container 2*a* for pressing out therefrom an appropriate quantity of color 56 from the color container 2*a* and through the hollow piston rod 52 and corresponding outlet conduit 3*a* to the previously discussed distribution means 10, namely via the associated supply opening 13*n* to the respective valve housing 14*n*, and for via the outlet opening 30*n* of the valve housing in the form of a color string 31 which ends up in the collection vessel 6.

The piston rod 52 can further be provided with an engaging mechanism 57 which will be effective when the corresponding color container 2*a* is to deliver a certain quantity of color to the distribution means 10, which entails that the lowering jib 55 will serve only the piston rod 52 and associated piston 50 for the selected color container 2*a*, whereas the remaining color containers remain non-influenced. Appropriately, the same mechanism 57 may be effective when the piston 50 has been guided all the way to the bottom of the respective color container 2*a*, which indicates an empty color container 2*a*, such that the piston 50 thereafter can be guided all the way out of the empty box for replacement respectively filling up of the same.

In order to secure that the piston 50 will empty the box 2*a* completely of color, even if the box 2*a* is provided with inclined, upwardly extending walls 2*aa*, the piston 50 is around its circumference appropriately provided with a flexible gasket 50*a* having such dimensions and being of such a material that all the time there will be executed a sealed pressing out of color 56, which is also illustrated, on a larger scale, in FIG. 7.

In order to ensure that the desired respective preset quantity of color will be let through the distribution means 10, the quantity of color 32 which has been collected in the collecting vessel 6, is subjected to control weighing by means of one or more weighing cells 60 which appropriately are positioned between the mixing vessel 6 and a displaceable rack 61. It is to be understood that this control weighing can be effected in cooperation with said control means 4, based on the outfeeding string of color 31 by means of an adaptive adjustment or lag adaption of expected outfeed of color quantity. This adaptive adjustment or lag adaption can be based on the outfeed of color string weight and/or time for pressing color through the associated valve, respective valve opening.

Since the mixing vessel 6 and the weighing cell or weighing cells 60 are arranged on a displaceable rack 61, preferably a rack 61 comprising not illustrated raising/lowering means, the distance between the mixing vessel bottom 6*a* or color surface 32*a* of already supplied color 32, can be regulated such that the color string 31 which is fed out through the valve 15, will have an approximately equal extension when hitting the mixing vessel bottom 6*a* or the color surface 32*a*.

Said control means 4 can thus after signal from the weighing cells 60 accomplish an accurately monitored mixing operation, said control means both compensating for tara weight and calculated lag of color. Said control means 4 control all movements, inter alia the individual valves, such that a larger quantity of color will pass through the large valve opening, whereas finishing fine dosage takes place through a lesser valve opening.

As an example of crude dosage there will, having an appropriate valve opening, pass from approximately 6 minutes in connection with dosage of approximately 2,5 kg color to approximately 15 seconds for dosage of 50 g color. Fine dosage of 2 g can take approximately 2,0 seconds. In connection with fine dosage of the range 0,2 g the weight of the color string can be precalculated either adaptably or as a lag.

It is to be understood that the number of valve sections can be varied within wide limits, depending on the practical number of base color including boxes in question. Further, it is to be understood that the output of color from the individual base color boxes can take place by means of other drive means than piston mechanisms, depending on the viscosity of the color in question. In connection with offset-color the viscosity can correspond to the consistency of vaseline or grease, but in connection with finely-fluid colors, there may be contemplated for example supply of color by gravitation, possibly in combination with a pumping supply through appropriate conduits and valves.

We claim:

1. Arrangement in a mixer, especially for printing color, which arrangement comprises:

a plurality of base color containers, each container containing a base color;

a plurality of outlet conduits, each outlet conduit being connected to one of said base color containers enabling said base color to pass through said outlet conduit;

a plurality of valves, each valve having a base color inlet opening, a base color outlet opening, and a flow control element wherein said flow control element regulates a predetermined quantity of base color which passes through said valve, each base color inlet opening being connected to one of said outlet conduits enabling said base color to be received into said valve;

a common mixing vessel for receiving said predetermined quantity of each said base color from said base color outlet openings of said valves; and a control means for controlling said predetermined quantity of each said base color which is received by said mixing vessel, said control means comprising a valve controller which actuates each flow control element allowing said predetermined quantity of each base color to pass through said outlet opening of said valve and to be received by said mixing vessel.

2. The arrangement as claimed in claim 1, said control means further comprising a preset program, said preset program being in instructional communication with said control means enabling said control means to instruct said valve controller in the actuation of said flow control elements.

3. The arrangement as claimed in claim 2, wherein the base colors received by said mixing vessel have a weight, and wherein said control means instructs said valve controller in the actuation of said flow control elements based on the weight of said base colors contained in said mixing vessel.

4. The arrangement as claimed in claim 3, said valve control means further comprising a drive means for raising and lowering said valve controller in order to actuate said flow control elements.

5. The arrangement as claimed in claim 4, wherein the plurality of valves are adjacent to and encircle said valve controller.

6. The arrangement as claimed in claim 5, wherein each valve further comprises a compressed air connection and said arrangement further comprises a compressed air supply connected to each compressed air connection, wherein said compressed air further assists in actuating said flow control elements.

7. The arrangement as claimed in claim 6, wherein said flow control elements comprise a piston.

8. The arrangement as claimed in claim 6, wherein said flow control elements have at least one small channel per passage of smaller quantities of color through said valve and at least one large channel for passage of larger quantities of color through said valve.

9. The arrangement as claimed in claim 6, wherein said plurality of valves are mounted on a tiltable mount for simplified inspection and maintenance.

10. The arrangement as claimed in claim 6, wherein said arrangement further comprises a means for raising and lowering said mixing vessel, said mixing vessel having a bottom surface, in order to maintain a substantially constant distance between said base color outlet opening and a surface formed by said base colors received by said mixing vessel or in order to maintain a substantially constant distance between said base color outlet opening and the said bottom surface of said mixing vessel.

11. The arrangement as claimed in claim 6, wherein said base color contained in each of said base color containers has a top surface, and wherein each of said base color containers further comprise bottom and side surfaces, a displaceable piston, said displaceable piston comprising a lid having an opening therethrough, a hollow piston rod having opposing ends with one end connected to said lid opening and said opposing end having an outlet opening, and a drive means affixed to said displaceable piston wherein said drive means raises and lowers said lid in said base color container, and wherein said lid is in contact with said top surface of said base color and in slideable contact with said side surfaces of said color container, and wherein said outlet opening is connected to said outlet conduit, and wherein said control means instructs said drive means in the raising and lowering of said lid, thereby enabling said displacement piston to press out said base color from said base color container through said hollow piston rod and into said outlet conduit.

12. The a rrangement as claimed in claim 11, wherein said displaceable piston further comprises a low level indicator indicating when said base color container requires refilling with base color.

13. The arrangement as claimed in claim 11, wherein said side surfaces of said base color container form an inclined surface and said lid, having a circumference, further comprises a flexible gasket means around said circumference of said lid, thereby forming a substantially continuous seal between said lid and said inclined surface of said base color container as said lid is raised and lowered by said displacement piston.

14. The arrangement as claimed in claim 2, wherein said control means instructs said valve controller in the actuation of said flow control elements based on said quantity of base color which passes through each valve.

15. The arrangement as claimed in claim 2, wherein said control means instructs said valve controller in the actuation of said flow control elements based on a duration of time in which each said flow control element is actuated.

* * * * *